US005438195A

United States Patent [19]

Franzen et al.

[11] Patent Number: 5,438,195

[45] Date of Patent: Aug. 1, 1995

[54] METHOD AND DEVICE FOR THE DIGITAL GENERATION OF AN ADDITIONAL ALTERNATING VOLTAGE FOR THE RESONANT EXCITATION OF IONS IN ION TRAPS

[75] Inventors: Jochen Franzen, Bremen; Gerhard Heinen, Grasberg; Reemt-Holger Gabling, Stuhr, all of Germany

[73] Assignee: Bruker-Franzen Analytik GmbH, Germany

[21] Appl. No.: 245,956

[22] Filed: May 19, 1994

[30] Foreign Application Priority Data

May 19, 1993 [DE] Germany ..... 43 16 737.3

[51] Int. Cl.[6] ..... H01J 49/42

[52] U.S. Cl. ..... 250/292; 250/282

[58] Field of Search ..... 250/292, 291, 290, 282

[56] References Cited

U.S. PATENT DOCUMENTS

| | | | |
|---|---|---|---|
| 4,761,545 | 8/1988 | Marshall et al. | 250/291 |
| 5,134,286 | 7/1992 | Kelley | 250/282 |
| 5,198,665 | 3/1993 | Wells | 250/282 |
| 5,347,127 | 9/1994 | Franzen | 250/292 |

FOREIGN PATENT DOCUMENTS

| | | |
|---|---|---|
| 0362432 | 4/1990 | European Pat. Off. . |
| 2267385 | 5/1992 | United Kingdom . |
| WO9305533 | 3/1993 | WIPO . |

OTHER PUBLICATIONS

Fernande Vedel, et al., A Sensitive Method For The Detection Of Stored Ions By Resonant Ejection Using A Wide-Band Signal pp. R11–R20, 1991.

*Primary Examiner*—Jack I. Berman
*Attorney, Agent, or Firm*—Bookstein & Kudirka

[57] ABSTRACT

A method and a device for the mass selective excitation of the secular oscillations of selected ion types in an RF quadrupole ion trap, including the simultaneous excitation of more than one ion type, is disclosed. The secular oscillation frequency is excited by resonances with specific frequencies of the frequency bands of the additional alternating fields, the frequency bands being generated digitally at a basic pulse rate $\Omega$. Interfering frequency side bands $\Omega-\omega$, $\Omega+\omega$, $2\Omega-\omega$, $2\Omega+\omega$, etc. arise, however, for each frequency $\omega$ within the frequency bands. These side bands can excite and eliminate other ions, which are not to be eliminated, in an undesired manner. The invention comprises forming the side bands in such a way that they only excite the selected ions. This is done by making the basic pulse rate for digital generation of the frequency bands for the additional alternating voltage identical with the frequency of the drive voltage of the ion trap or with an integral multiple of it and coupling the basic pulse rate to it in locked phase relation.

19 Claims, 8 Drawing Sheets

METHOD AND DEVICE FOR THE DIGITAL GENERATION OF AN ADDITIONAL ALTERNATING VOLTAGE FOR THE RESONANT EXCITATION OF IONS IN ION TRAPS

FIELD OF THE INVENTION

The invention relates to a method and a device for the mass selective excitation of the secular oscillations of selected ion types in an RF quadrupole ion trap, including the simultaneous excitation of more than one ion type. Mass selective excitation can be used to eliminate undesired ion types from the ion trap, to increase the kinetic energy of ion types for fragmentation by collisions with a collision gas, or to generate oscillations for FT ion traps.

BACKGROUND OF THE INVENTION

It is known in principle from U.S. Pat. No. 4,761,545 (Marshall, Ricca and Wang) that several ion types can be simultaneously excited by a frequency mixture and, if so wanted, eliminated from the storage cell. The patent explicitly refers to both ion cyclotron resonance spectrometers (ICR) and quadrupole ion traps. From EO 0 362 432 A1 (Franzen and Gabling), it is known that undesired ions can be eliminated by this means during storage in ion traps, that their secular oscillation frequency is excited by dipolar additional alternating fields in such a manner that they enlarge the amplitude of their secular oscillation by resonant energy absorption in the axial alternating field and thus leave the storage field. Quadrupolar excitation with this aim in view is also known from U.S. Pat. No. 5,134,286 (Kelley).

A method of this kind can be used to eliminate the ions of an individual mass, for instance, by applying a single frequency to the two end caps of an ion trap, which is in resonance with the secular oscillation $\omega_z$ of the undesired ion in the z-direction of the ion trap (direction of the axis through the two end caps). The ions of several masses can, however, also be simultaneously eliminated by applying several frequencies at the same time. In extreme cases, all ions except those of one or more desired masses can be prevented from storage by frequency mixtures with one or more gaps so that only the ions of the desired masses are stored. The necessary frequency mixture of the additional field can be calculated (for example, as stated in U.S. Pat. No. 4,761,545) or determined in experiments. In U.S. Pat. No. 5,134,286 (Kelley) white noise is used, in which frequency gaps ("notches") are generated by filtering. The notches then determine the ion species remaining in the ion trap.

For storage the ions can be generated in known manner both internally in the ion trap itself and externally in a special ion source. For internal generation the substances to be ionized are introduced into the ion trap in vapor form. Electrons can then be shot into the ion trap through openings, where they ionize the substance molecules in the usual manner. Other known methods of internal ionization can, however, also be used such as chemical ionization (CI) by reactant gas ions or photoionization by high-energy photons, for example from a LASER. Different kinds of ion generation from surfaces can also be carried out in the ion trap.

Any ion sources can be used for external ionization. The ions are focused into the ion trap after their generation with low kinetic energy, slowed down in it by a collision gas, and thus trapped.

Physical Principles

The secular frequencies $f_s$ of any ions of stored masses in an ion trap are in the range $f_s=0$ to $f_s=F/2$, F being the frequency of the RF drive voltage. The secular frequency is clearly dependent on the mass of the ions for a fixed operating mode of the ion trap. For resonant excitation of the secular frequencies of these ions, excitation frequencies $\omega$ are therefore required, ranging from $\omega=0$ to $\omega=F/2$. If digital generation of these frequencies is required, a basic pulse rate $\Omega$ is necessary for generating the analog values, this being at least twice the size of $f_{s,max}$. The basic pulse rate $\Omega$ must therefore be greater than or at least equal to F.

The secular frequencies of the ions can, however, also now be excited by frequencies which are not in this range $f_s=0, \ldots, F/2$. From the solution of Mathieu's differential equation, it can be seen that the secular oscillation of the ions also contains components with higher frequencies, the so-called side-band frequencies of the form $(vF\pm f_s)$ where $v=1, 2, 3, \ldots$, that is, $(F-f_s)$, $(F+f_s)$, $(2F-f_s)$, $(2F+f_s)$, etc.

FIG. 1 shows the form determined by calculations of the secular oscillations of the ions in an ion trap for singly charged ions of three different masses. FIG. 2 and FIG. 3 show Fourier analyses of calculated oscillations of this kind for different masses, the side-band frequencies becoming visible. From FIG. 1 (above) it can be seen that the secular oscillation is sine-wave oscillations of the secular frequency $f_s$, upon which a further sine-wave oscillation of the drive frequency F is superposed. This multiplicative superposition of the form $\sin(f_s)*\sin(F)$ also already clearly leads to the side bands stated above via the known trigonometric conversion $\sin(f_s)*\sin(F)=\frac{1}{2}(\cos(F-f_s)-\cos(F+f_s))$.

FIG. 4 shows, again by computer simulations which are carried out by means of differential calculations, how the ions in the ion trap can also be excited via a dipole alternating field with the frequency of the side bands. Although the excitation constantly becomes weaker for the higher side bands, it is, nevertheless, clearly present. In FIG. 5, the weaker excitation for the higher side bands is compensated for by larger voltages of the dipolar applied additional frequency. Here, the linear increase in the amplitude of the secular oscillation of the ions can be seen well until the ions are eliminated from the ion trap by colliding with the end caps (broken lines).

Consequently, it is necessary to ensure that the frequency mixture for the excitation of selected ions does not contain any frequency components affecting the non-selected ions via excitation of the side bands.

Modern ion traps are largely controlled digitally. Thus, for example, the frequency of the drive voltage is generated digitally by a crystal oscillator using logic circuits. The amplitude of this drive voltage is also controlled digitally. Consequently, it would seem appropriate that generation of the frequency mixture for the alternating voltage of the additional field for ion excitation should also be digital.

Electronic Principles

For the chemist working in mass-spectroscopic development, it is now surprising that digitally generated frequency mixtures also contain side bands. These have a negative effect in many applications (for example, in CD audiotechnology) and must be filtered out by special measures. Since the manufacture of sharply clipping filters is very difficult, other techniques (oversampling in particular) have been developed which place the side bands in the highest frequency ranges possible, enabling them to then be removed with conventional filters.

The digital generation of a frequency mixture for the excitation of ions in mass-spectrometric storage cells (without removing the side bands) is actually known from the patent quoted above, U.S. Pat. No. 4,761,545. The frequency mixture required can be calculated by the addition of equidistant amplitude values of the superposed frequencies required with suitable superposition phases or by Fourier transformation from required frequency bands. The phases must be selected in known manner in such a way that it is impossible at all times for all frequencies with their maximum amplitudes to superpose upon each other. This can be achieved by a nonlinear phase displacement of the equidistantly successive frequencies with suitable weighting of the individual frequencies. The digitally stored amplitude values are then supplied to a suitable digital-to-analog converter at a fixed basic pulse rate, which generates the voltage values of the frequency mixture.

This digital generation of frequency mixtures generates, however, not only the required mixture of frequencies but also the aforementioned side bands. Higher side-band frequencies $(\Omega-\omega)$, $(\Omega+\omega)$, $(2\Omega-\omega)$, $(2\Omega+\omega)$ etc. are generated for each frequency generated, $\Omega$ being the frequency of the basic pulse rate. As is known from digital audiotechnology (CD=compact discs, DAT=digital audio tapes), the spurious side bands require an elaborate technique for their removal, involving multiplication of the fundamental frequency (oversampling) and filtering-out of the side bands which are then at higher frequencies. For frequency generation in the 0 to 22 kHz range, a basic pulse rate of only 44 kHz would be required for outputting the digital values to the DAC (digital-to-analog converter) if it were not for the spurious side bands. The fundamental frequencies distorted by the side bands do not, however, sound good. For this reason, the basic pulse rate is placed at very much higher frequencies, for instance, at 8*44=372 kHz with 8-fold oversampling, the first side bands occurring in the 350 kHz to 372 kHz range and the further side bands in the range above 372 kHz. For most applications, these can be satisfactorily removed by normal low-pass filters. Higher-quality audio equipment even uses much higher frequency ranges.

In the case of ion trap mass spectrometers, very much higher frequencies are involved. With a drive frequency of one megahertz for the ion trap, the secular frequencies are located in the 0 to 500 kHz range. Eight-fold oversampling would already result in an output rate of 8 MHz. The transient rate of the accompanying DAC would have to be below 125 nanoseconds. Apart from being expensive, the dynamic performance of these converters is limited. Digital-to-analog converters with corresponding speed and the required dynamic range of at least 16 bits are available on the market at extreme prices only for special applications. An initial commercially available additional unit for ion traps, providing digital generation of frequency mixtures for the purpose above, uses a basic pulse rate of 10 MHz and 12-bit output dynamics.

For the oversampling technique, there are, in addition, two requirements complicating generation of the frequencies. The storage area for storing the amplitude values calculated must either be very large to be able to accommodate all the values to be output or there must be an arithmetic unit working in synchronization with the outputs, which interpolates the values. The cost of this arithmetic unit rises too if the output clock-pulse rate rises.

Therefore, it is among the objects of the invention to find a method of nullifying the effect of the side bands, which arise with digital generation of a frequency mixture, on the desired ions, without having to apply a price-increasing oversampling technique.

SUMMARY OF THE INVENTION

The invention relates to a method and a device for the mass selective excitation of the secular oscillations of selected ion types in an RF quadrupole ion trap, including the simultaneous excitation of more than one ion type. Mass selective excitation can be used to eliminate undesired ion types from the ion trap, to increase the kinetic energy of ion types for fragmentation by collisions with a collision gas, or to generate oscillations for FT ion traps.

The secular oscillation frequency is excited by resonances with specific frequencies of the frequency bands of the additional alternating fields, the frequency bands being generated digitally at a basic pulse rate $\Omega$. Interfering frequency side bands $\Omega-\omega$, $\Omega+\omega$, $2\Omega-\omega$, $2\Omega+\omega$, etc. arise, however, for each frequency $\omega$ within the frequency bands. These side bands can excite and eliminate other ions, which are not to be eliminated, in an undesired manner.

Specifically, the invention comprises forming the side bands in such a way that they only excite the selected ions. This is done by making the basic pulse rate for digital generation of the frequency bands for the additional alternating voltage identical with the frequency of the drive voltage of the ion trap or with an integral multiple of it and coupling the basic pulse rate to it in locked phase relation.

It is known from EO 0 362 432 A1 that undesired ions can be excited by dipolar or quadrupolar additional alternating fields of specific frequency bands during the storing process in such a way that they are not stored. Their secular oscillation frequency is excited by resonances with specific frequencies of the frequency bands of the additional alternating fields in such a way that the resonating ions leave the storage field due to the absorption of energy, generally by colliding with the electrodes of the ion trap.

The frequency bands for the additional alternating fields can be generated digitally in a known manner, the stored amplitude values of the additional alternating voltage being supplied to a digital-to-analog converter at the basic pulse rate $\Omega$. As noted, interfering frequency side bands $\Omega-\omega$, $\Omega+\omega$, $2\Omega-\omega$, $2+\omega$, etc. arise for each frequency $\omega$ within the frequency bands. These side bands can excite and eject other ions, which are not to be eliminated, in an undesired manner.

BRIEF DESCRIPTION OF THE DRAWINGS

The above and further advantages of the invention may be better understood by referring to the following description in conjunction with the accompanying drawings, in which.

DETAILED DESCRIPTION OF ILLUSTRATIVE EMBODIMENTS

The invention comprises forming the side bands in such a way that they too only excite the selected ions. This is done by making the basic pulse rate for digital generation of the frequency bands for the additional alternating voltage identical to the frequency of the drive voltage of the ion trap (or to a multiple of this) and coupling it to the latter in locked phase relation.

The mathematical equations for the side bands of the secular frequencies of the ions in an ion trap and for the side bands of digital generation of electrical alternating voltages are surprisingly similar both for the mass-spectrometric expert and for the electronic expert. Closer analysis reveals the reason to be a very similar basic principle for the development of the two types of side band.

Basically, the invention involves making the fundamental frequency $\Omega$ for digital generation of the additional alternating voltage to eliminate the undesired ions precisely equal to the frequency F for the drive voltage of the ion trap.

This, namely, will cause only the undesired ions, already excited for elimination by the excitation frequency $\omega=f_s$, to be affected via the digitally generated side bands $(\Omega-\omega)=(F-f_s)$, $(\Omega+\omega)=(F+f_s)$ etc. of the alternating voltage. Here, use is thus made of the fact that the equations for the side-band frequencies of the secular frequency in an ion trap according to Paul have precisely the same mathematical form as the equations of the side bands with clocked frequency generation from digital amplitude values.

The same applies if the fundamental frequency $\Omega$ is equal to an integral multiple of the drive frequency $F:\Omega=vF$, v being integral.

Figure 1A:
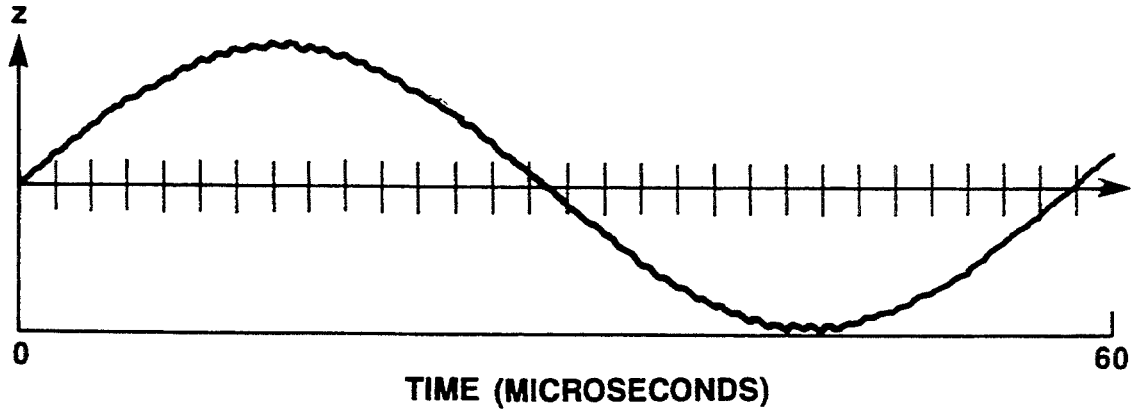
FIG. 1 shows the secular oscillations of ions within an ion trap, only the motion in the z-axis being observed. The oscillations are shown for three different masses. In the upper diagram, the multiplicative superposition of the sine-shaped secular oscillation with the impressed frequency of the storing RF field can be seen. The lower diagram depicts the beat of the secular oscillation $\omega$ with its own side-band frequency $\Omega-\omega$.
Figure 1B:
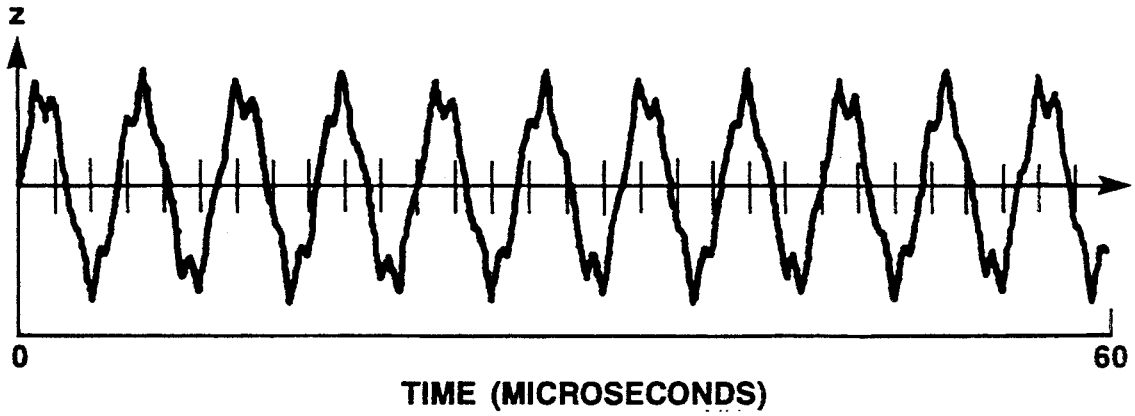
Figure 1C:
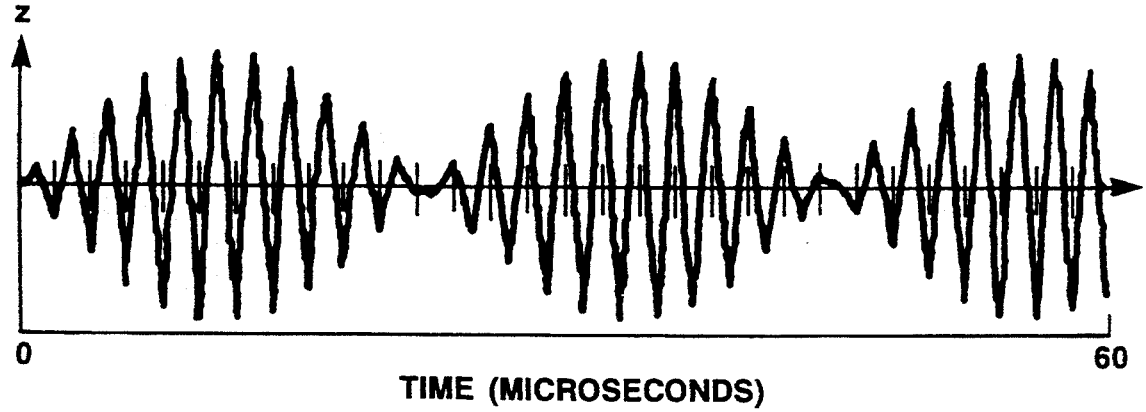
Figure 2A:
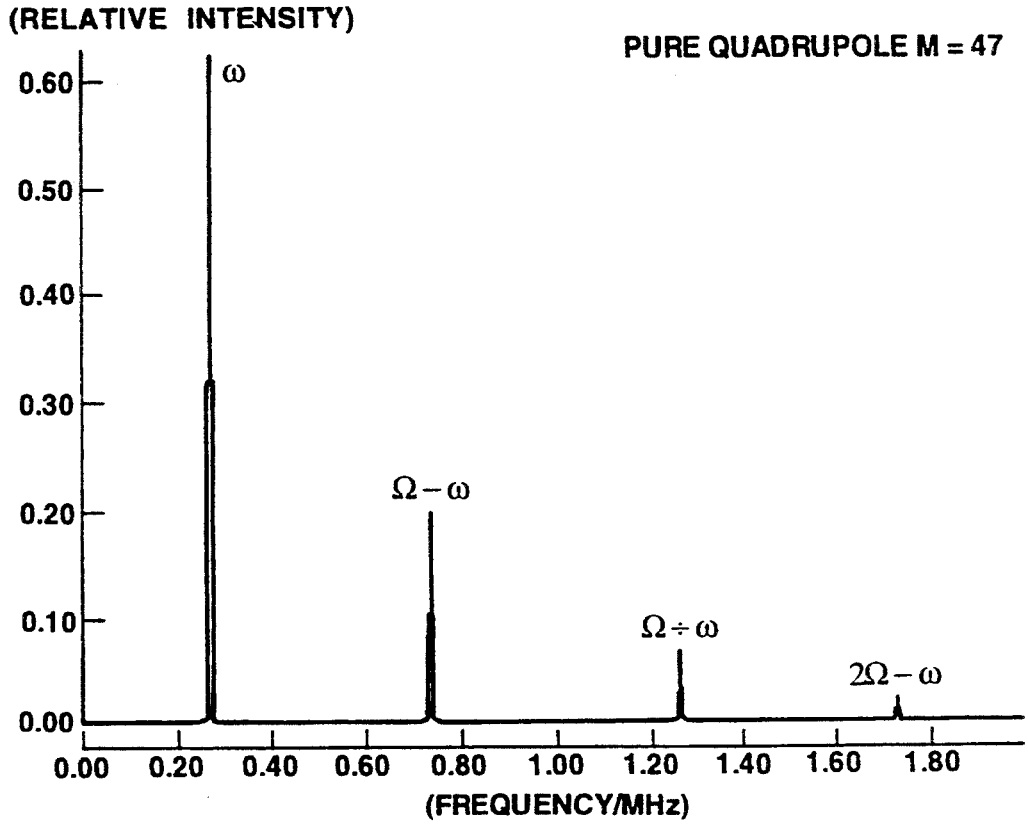
FIG. 2 shows the frequencies of the secular oscillation of ions in a pure quadrupole ion trap as established by a Fourier analysis of the calculated secular oscillation. The side-band frequencies $\Omega-\omega$, $\Omega+\omega$ and $2\Omega-\omega$ can be seen. The lower diagram is enlarged by a factor of 20.
Figure 2B:
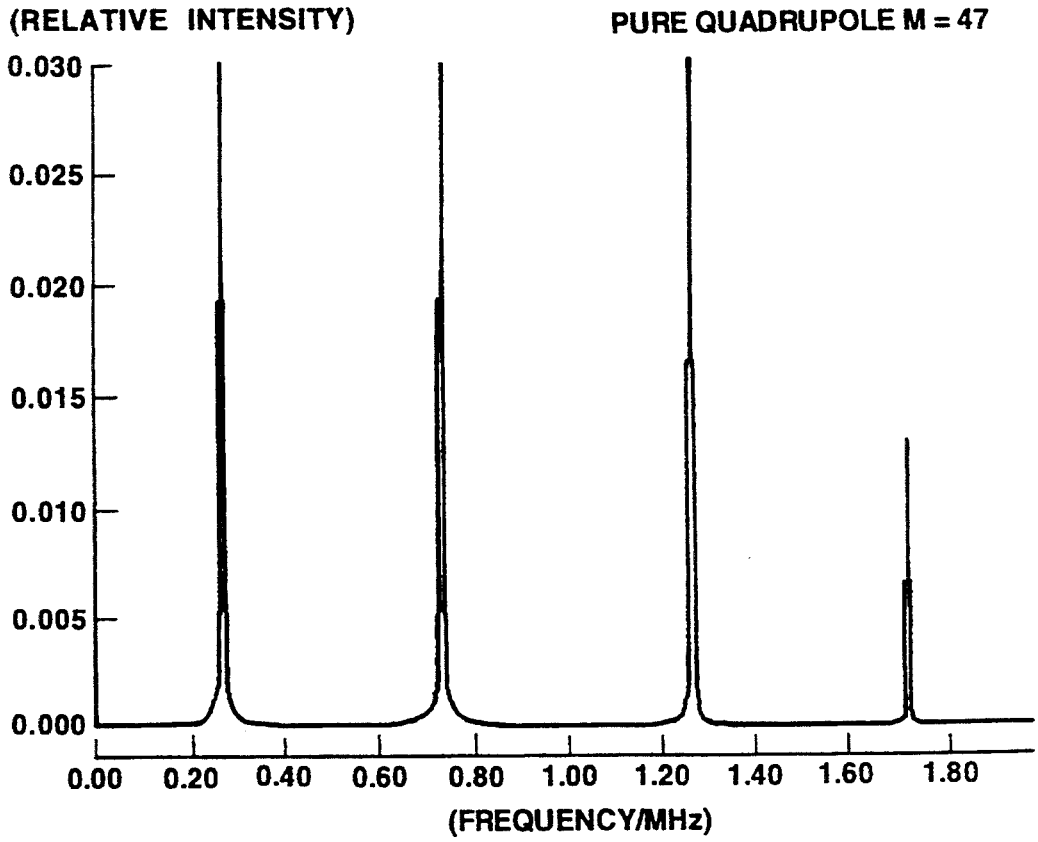
Figure 3A:
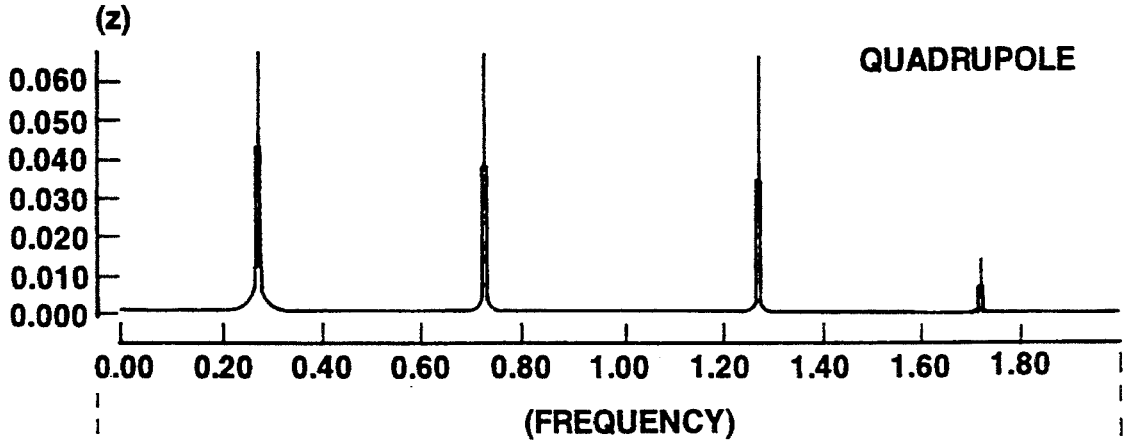
FIG. 3 shows the Fourier analyses of the secular oscillations for three different masses. The displacement in opposite directions of the side-band frequencies can be seen.
Figure 3B:
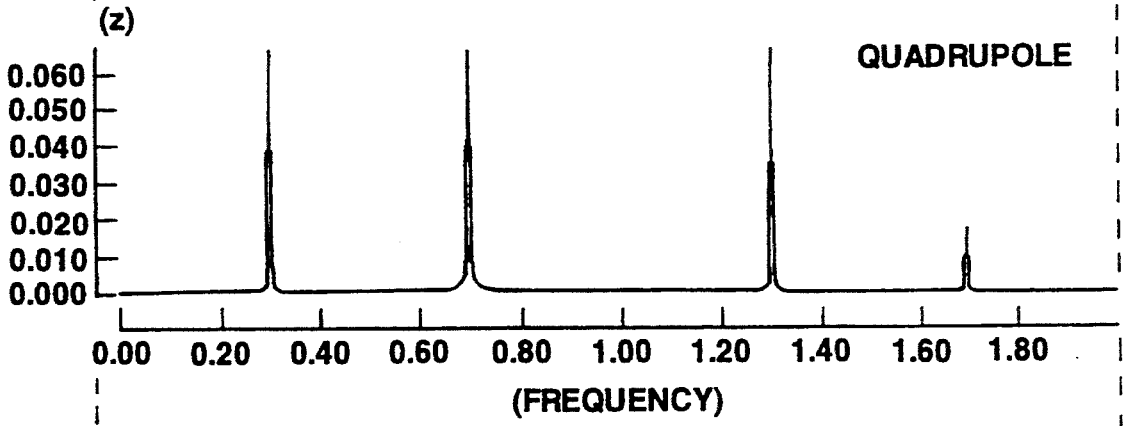
Figure 3C:
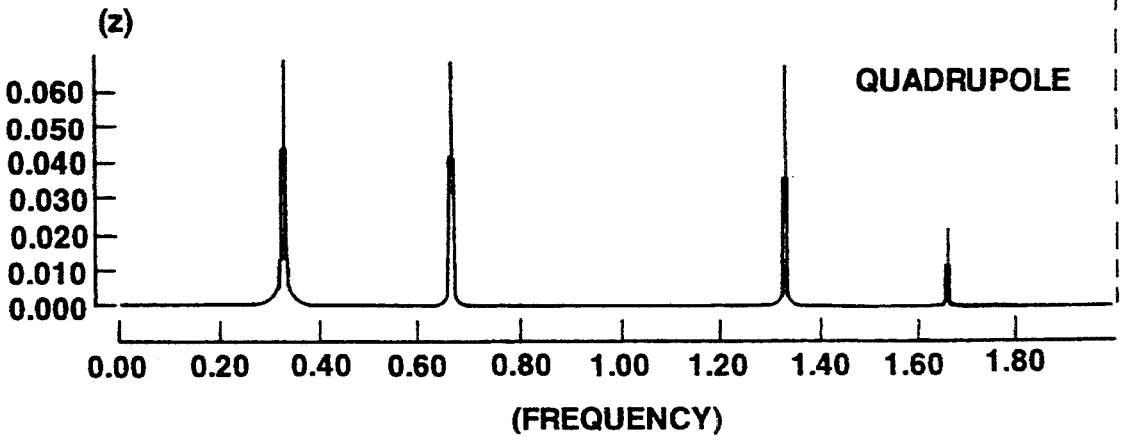
Figure 4A:
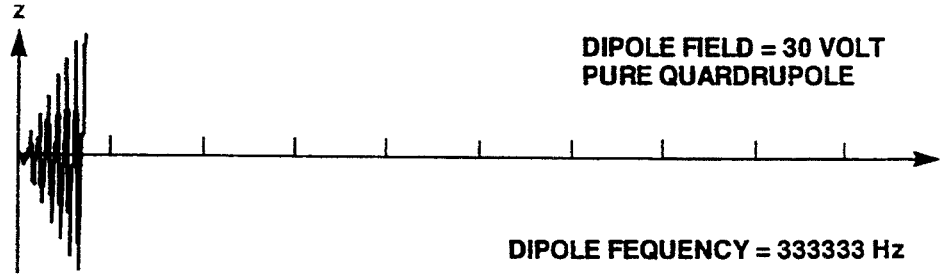
FIG. 4 shows the calculated excitation of the oscillation of ions via the side-band frequencies of their secular oscillation. Although the excitations become weaker towards higher side bands, they must never be ignored.
Figure 4B:
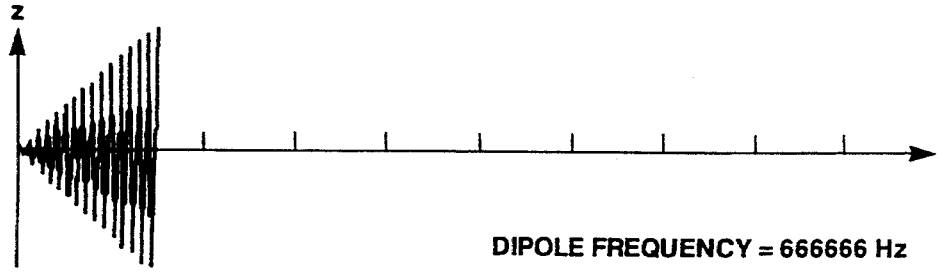
Figure 4C:
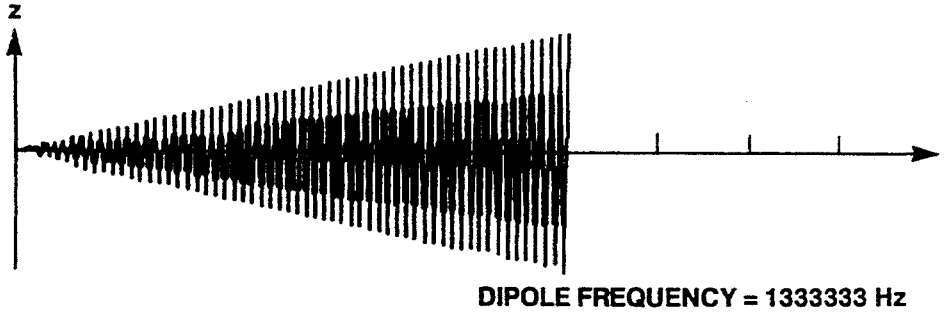
Figure 4D:
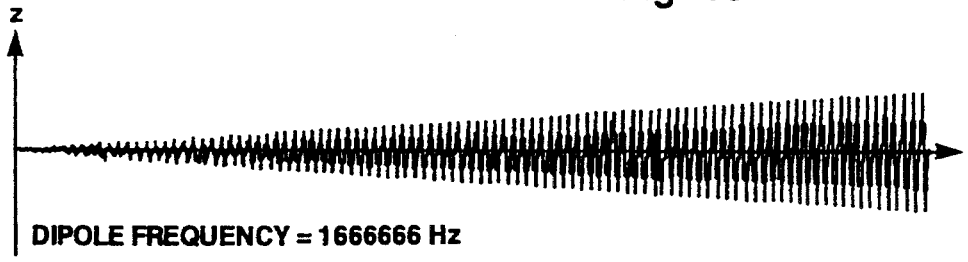
Figure 4E:
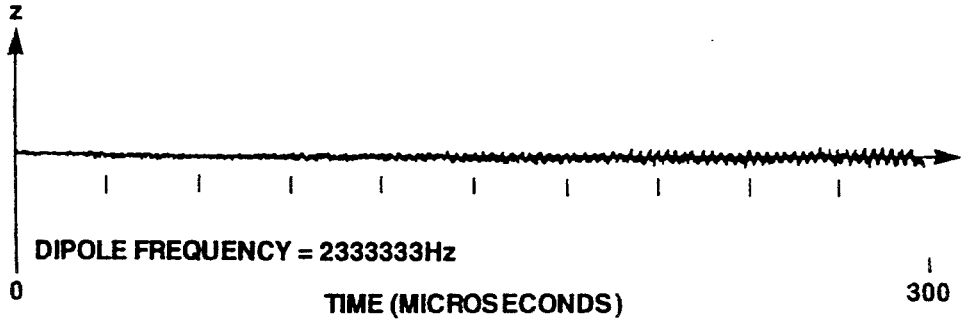
Figure 5A:
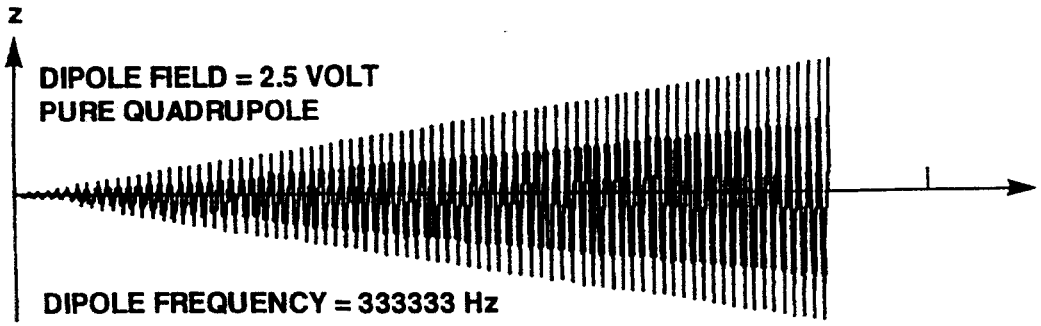
FIG. 5 again shows excitation of the ion oscillations by dipole fields which just correspond to the frequencies of the side bands. Here, the weaker excitation due to higher side bands is approximately compensated for by an increase in dipole voltages. The linear rise in oscillation amplitudes as excitation time elapses may be seen.
Figure 5B:
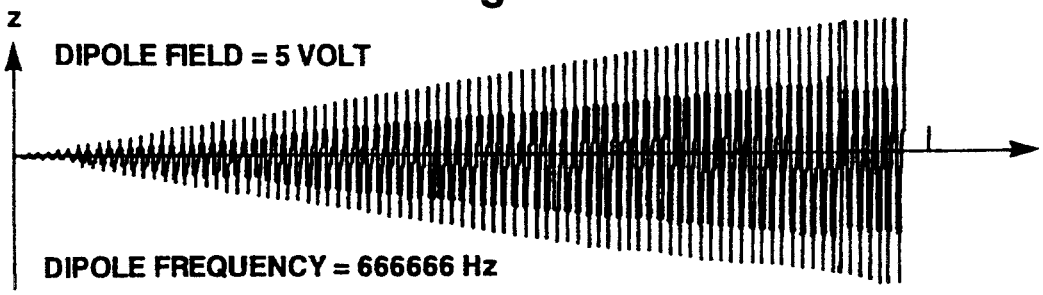
Figure 5C:
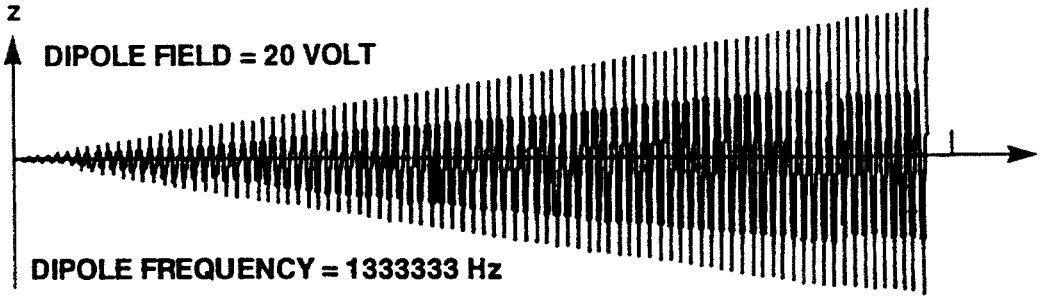
Figure 5D:
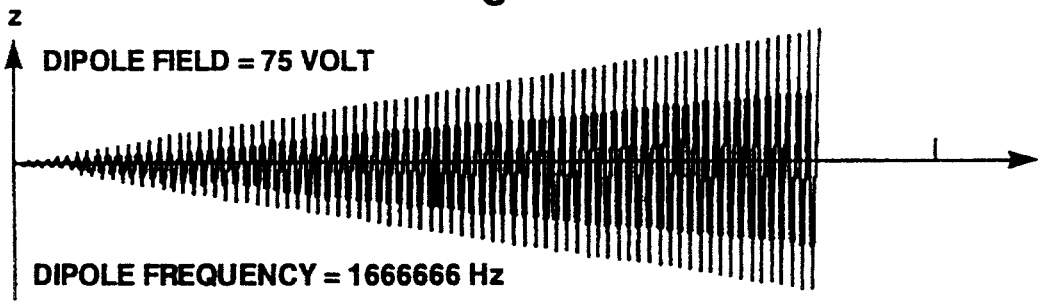
Figure 5E:
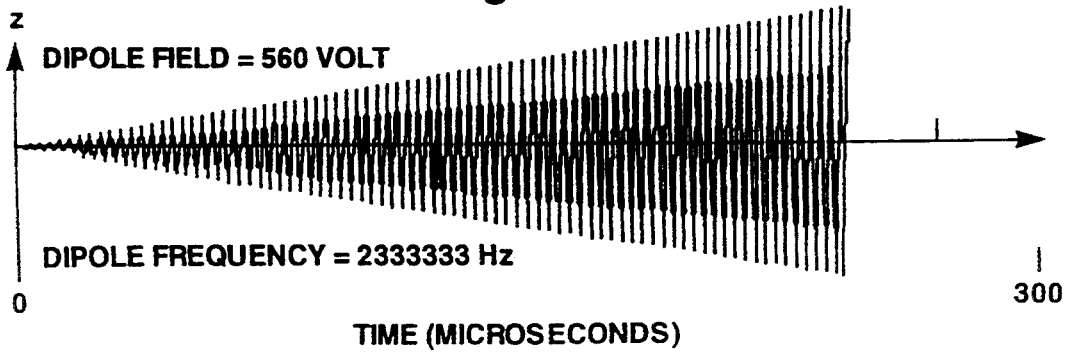
Figure 6A:
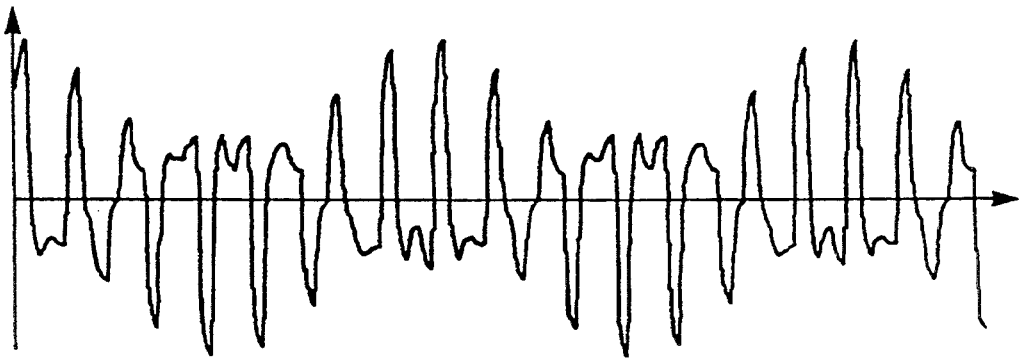
FIG. 6 shows the form of the voltage shape with digital frequency generation at a generation rate of 1 MHz, above for a DAC with slow transient rate, below with fast transient rate. Frequencies of 250 kHz and 470 kHz were generated. The Fourier analyses of the frequencies generated are shown with the side-band frequencies below the voltage shapes in each case. The side bands up to a fourfold generation frequency are depicted. It can be seen that the frequencies remain exactly the same, only the intensity distributions of the frequencies changing.
Figure 6B:
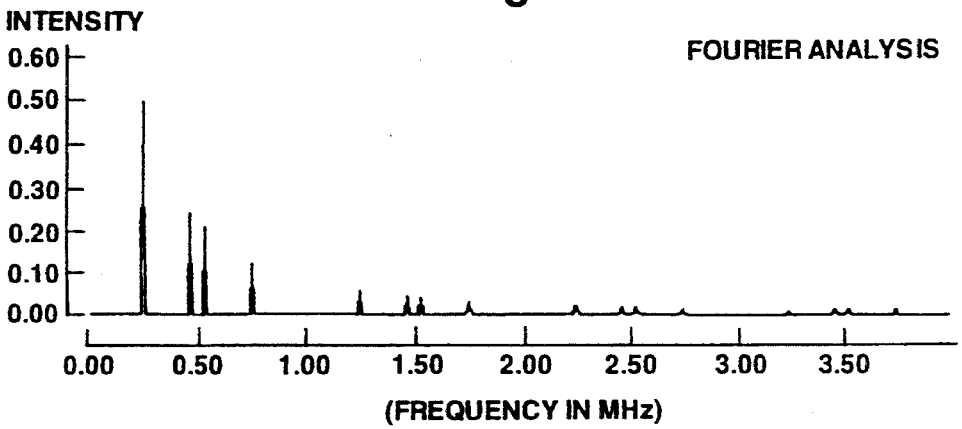
Figure 6C:
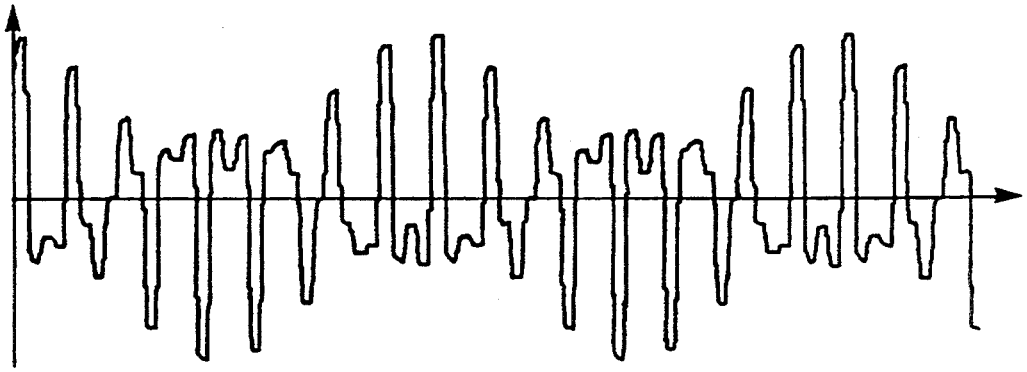
Figure 6D:
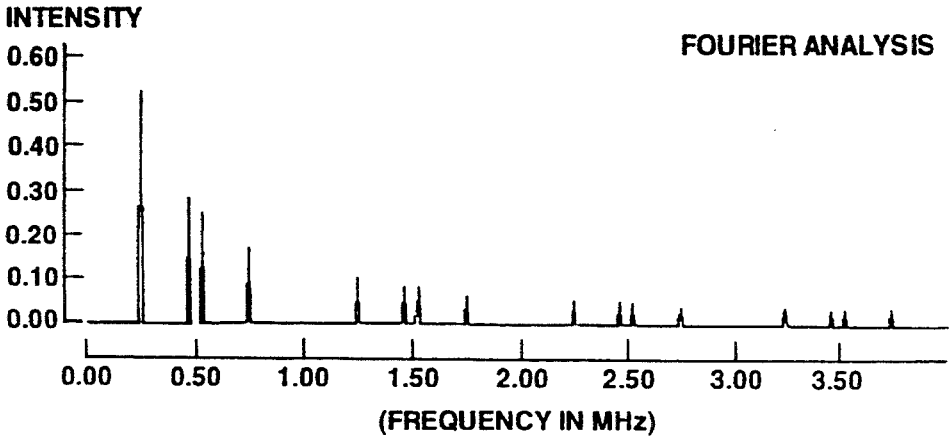
Figure 7:
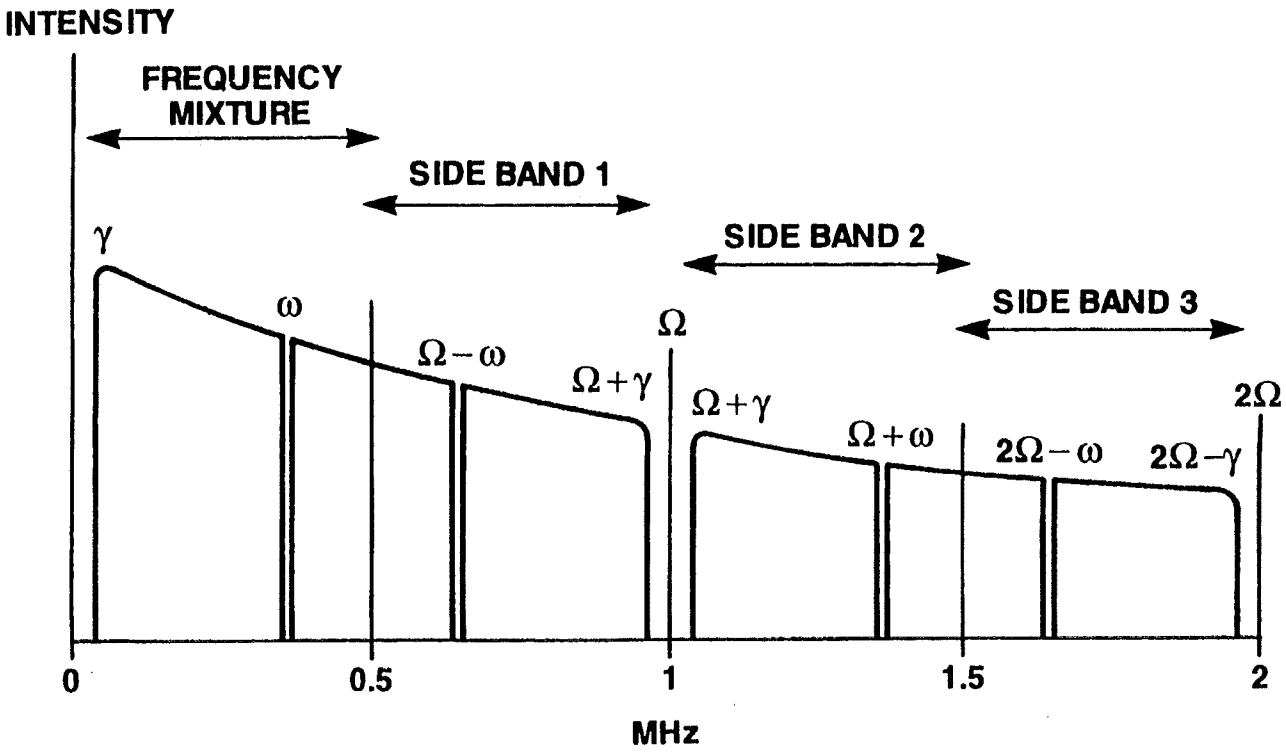
FIG. 7 shows the side-band principle for a quasi-continuous frequency mixture. The digitally generated frequency mixture begins at a lower limit frequency $\gamma$ and runs to $\Omega/2$ with a narrow gap at the frequency $\omega$. The frequency mixture can be used to eject all ions up to an upper ion mass corresponding to the secular frequency $\gamma$ from an ion trap. Only the desired ion type, the secular frequency of which corresponds to the frequency $\omega$ of the gap, remains in the ion trap. The three side bands shown form automatically as a result of frequency generation. They each contain the gaps $\Omega-\omega$, $\Omega+\omega$ and $2\Omega-\omega$. Due to the existence of these gaps, the side bands of the desired ion type also escape excitation.
Figure 8:
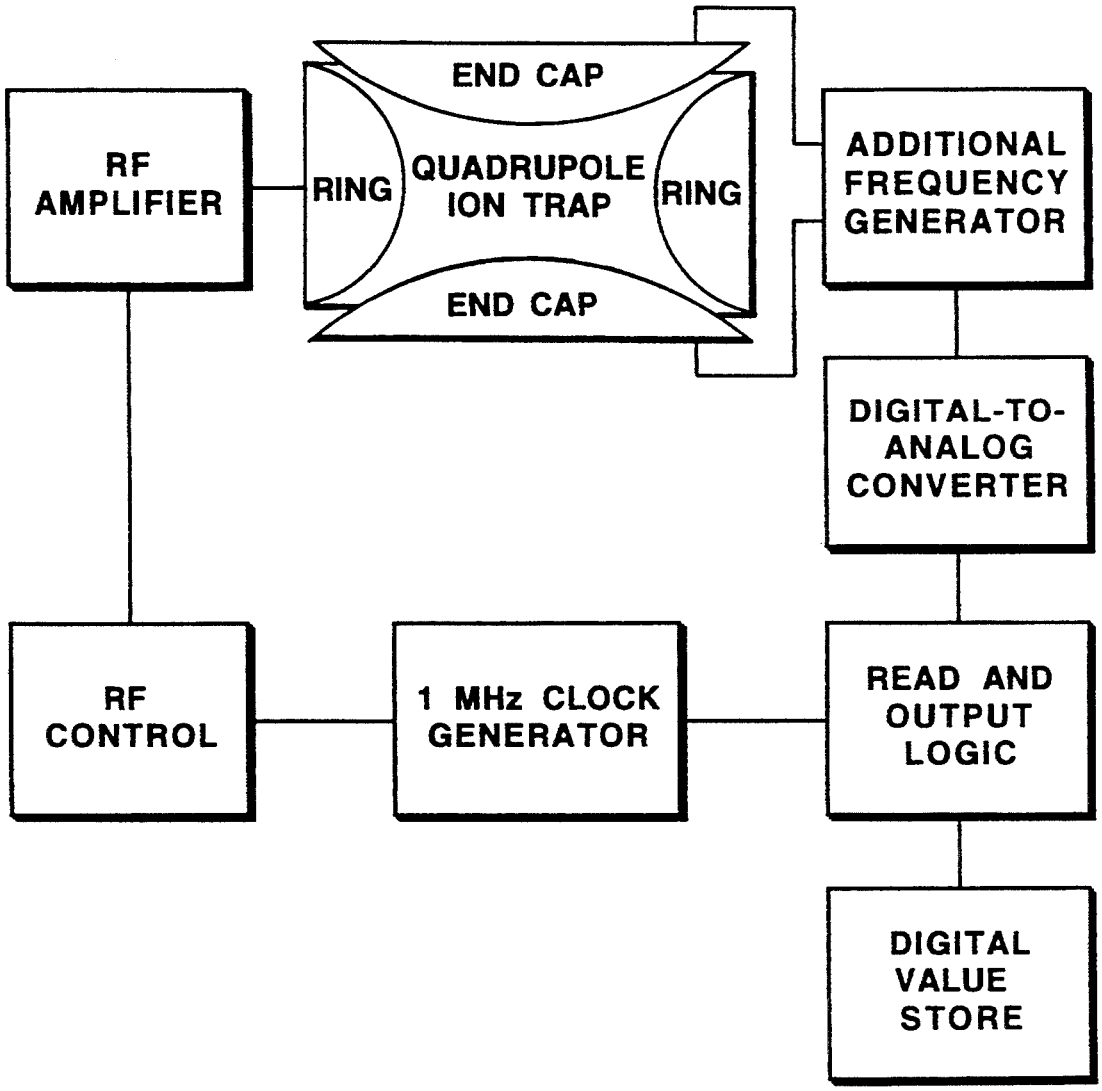
FIG. 8 shows the block diagram of the elements essential to the invention of an apparatus for digital generation of the additional frequency mixture. Further elements are required for operation of an ion trap mass spectrometer.

FIG. 6 shows the form of the digitally generated electrical alternating voltage for two DACs with transient responses varying in speed. The diagrams were again obtained by mathematical simulation. Two different frequencies were generated simultaneously in each case, 450 kHz and 250 kHz. The output clock pulse is 1 Mhz. The results of Fourier frequency analyses are shown below the alternating-voltage diagrams. It can be seen that the frequency of the side bands is independent of the transient response of the DACs. Only the intensity of the side-band frequencies depends on the transient response. The case is similar for additional filters.

The similarity in side-band generation is due to the fact that the fundamental frequency (transients at the rate of digital frequency generation on the one hand, drive frequency of the ion trap on the other) is multiplicatively superposed upon the oscillations generated (electrical alternating voltage on the one hand, secular oscillation of the ions on the other) in both cases. The multiplicative superposition is characterized in that the impressed fundamental oscillations are proportional to the oscillation amplitude and that the sign of the impressed fundamental oscillations in the negative half wave changes in relation to the positive one. Over many half waves the impressed fundamental oscillations thus completely average themselves out and cannot therefore be seen at all in the results of Fourier analyses.

A preferred method provides for calculation of the frequencies of the additional voltage for elimination of the undesired ions, determination from these frequencies of the amplitude values at the basic pulse rate interval, and their loading in a fast digital memory. If the drive frequency of the ion trap is just one megahertz and generation and storage is to be approximately 32 milliseconds, 32,000 amplitude values will be required. With a dynamic range of 16 bits, this would result in a storage requirement of 64 kilobytes, a particularly small and inexpensive digital memory by today's standards. It would be possible to store 16 precalculated frequency mixtures in a conventional memory with a size of one megabyte.

The small size of the memory also offers the advantage of being able to change the memory contents by calculations. Thus, it is frequently necessary to compute a single frequency of the many superposed frequencies out of a memory with uninterrupted noise very quickly by subtraction. Using a 16-bit microprocessor able to calculate a sine value in approximately one microsecond, the entire arithmetic operation takes only approximately 40 milliseconds.

For excitation of ions with frequencies of this kind, making up just one fraction $f_s=F/n$ (n being an integer) of the frequency F of the drive voltage, the excitation frequency to drive frequency phase has proved to be extremely important in experiments. As a further embodiment, it is therefore proposed that the fundamental frequency $\Omega$ be also coupled with the drive frequency F in locked phase relation, the mutual phase position being adjustable.

The amplitude values are read out for an ion trap with a radio frequency of 1 MHz at a rate of precisely this one megahertz and supplied to a digital-to-analog converter (DAC). Loading of the DAC would be in a fixed phase relationship with the drive frequency, the drive frequency and the basic pulse rate being conveniently derived from a single (crystal) oscillator. A logic circuit would be able to provide for (adjustable) phasing.

The additional voltage generated is supplied to the two end caps of the ion trap with opposed phase position if dipolar excitation is to take place. If quadrupolar excitation is required, the additional voltage can be supplied to the two end caps in phase or to the ring electrode. Mixtures of dipolar and quadrupolar excitation are also possible and are advantageous for certain applications. These exist if the ions collected at the center of the ion trap are to be excited a little but not with full power, while the ions generated at the outer area of the trap are to receive the full effect of an eliminating additional field. It is also possible to supply only one end cap, the other end cap having ground potential. This arrangement is frequently referred to incorrectly as "monopolar" excitation. In reality, it is a superposition of a dipolar and quadrupolar excitation, each with half field intensity.

A further preferred embodiment of the ion trap has higher-order superposed multipoles since these are able to have a favorable effect on the ejection behavior of the ions. In particular, combinations comprising weakly superposed hexapole and octopole fields can cause the ions to be ejected in only one axial direction while displacement of the frequency with growth in the secular oscillation amplitude nevertheless remains within narrow limits.

The method given here can, for example, also be used for joint fragmentation of several ion types after their isolated storage. A method of this kind offers a particularly sensitive search method for the individual or joint occurrence of more than one preknown dangerous substance.

Numerous applications of RF quadrupole ion traps require the resonant excitation of the secular oscillation of one or more ion types stored in the trap.

For the operation of an RF ion trap mass spectrometer according to Wolfgang Paul and Helmut Steinwedel, it can, for example, be advantageous to store only ions with specific, desired masses, for instance, if only a specific ion type is to be examined. In particular, this enables a large number of the desired ions to be stored since the number of the total ions to be stored in an ion trap is limited by the space-charge effect of the ions.

To quote an example, one of the reasons why the examination of ion types of one or less selected masses in an ion trap is particularly advantageous is that it is possible to generate daughter ions of the examined ion type by collisionally induced fragmentation, which are able to provide information concerning the structure of the ion type. On the other hand, the increased sensitivity of this method can serve to measure individual substances in complex mixtures with a particularly high detecting power. Due to the generation of daughter ions, the certainty of the detection of a sought substance can also be increased.

The foregoing description has been limited to specific embodiments of this invention. It will be apparent, however, that variations and modifications may be made to the invention, with the attainment of some or all of its advantages.

Therefore, it is the object of the appended claims to cover all such variations and modifications as come within the true spirit and scope of the invention.

What is claimed is:

1. A method for exciting secular oscillations of ions of selected mass-to-charge ratios in an RF quadrupole ion trap by resonances of their secular oscillations with a field of an additionally applied electrical alternating voltage generated via a digital-to-analog converter at a constant basic pulse rate from digitally stored amplitude values, said method comprising the step of:

making a frequency of the basic pulse rate of generation of the digital alternating voltage one of identical with the drive radio frequency of the ion trap and equal to an integral multiple thereof.

2. The method of claim 1, wherein the additional alternating voltage comprises a weighted mixture of different frequencies.

3. The method of claim 1, further comprising the step of coupling in locked phase relation the basic pulse rate for generation of the additional alternating voltage to the drive radio frequency.

4. The method of claim 3, wherein the phase is made adjustable.

5. The method of claim 1 further comprising the step of applying the additional alternating voltage to one or both end caps of an ion trap comprising ring and end cap electrodes.

6. The method of claim 1 further comprising the step of applying the additional alternating voltage to the ring electrode of an ion trap comprising ring and end cap electrodes.

7. The method of claim 1, wherein excitation of the ions takes place during ion generation in the ion trap.

8. The method of claim 1, wherein excitation of the ions takes place during the introduction of externally generated ions into the ion trap.

9. The method of claim 1 further comprising the step of employing excitation of the secular frequencies for removal of stored ions.

10. The method of claim 1 further comprising the step of employing excitation of the secular frequencies for collisionally induced fragmentation of stored ions.

11. The method of claim 1 further comprising the step of employing excitation of the secular frequencies for the isolation and fragmentation of stored ions.

12. The method of claim 1 further comprising the step of superposing higher multipole fields upon a basic quadrupole field of the ion trap.

13. The method of claim 1 further comprising the step of submitting the ions in the ion trap to a mass-spectrometric analysis.

14. The method of claim 13 further comprising the step of performing the mass-spectrometric analysis by ion ejection with a mass selective instability scan.

15. The method of claim 12 further comprising the step of performing the mass-spectrometric analysis by ion ejection with a nonlinear resonance scan.

16. A method of claim 13 further comprising the step of performing the mass-spectrometric analysis by ion ejection with a dipolar resonance scan.

17. An ion trap mass spectrometer having an additional alternating voltage supply for resonant excitation of ions, said ion trap mass spectrometer comprising:

a digital-to-analog converter; and means, coupled to said converter, for storing digital amplitude values, said values generating an additional alternating voltage via said digital-to-analog converter at a rate of one of an ion trap drive radio frequency and an integral multiple of said frequency.

18. The ion trap mass spectrometer of claim 17, wherein the additional alternating voltage comprises a mixture of alternating voltages of different amplitudes and frequencies.

19. The ion trap mass spectrometer of claim 17, wherein the drive radio frequency and a clock pulse period of digital generation of the additional alternating voltage originate from a common clock generator.

* * * * *